US011203130B2

(12) United States Patent
Vaucher et al.

(10) Patent No.: US 11,203,130 B2
(45) Date of Patent: Dec. 21, 2021

(54) SAFETY DEVICE FOR A BANDSAW

(71) Applicant: AUMATECH, Sainte Luce sur Loire (FR)

(72) Inventors: Ronan Vaucher, Carquefou (FR); Pierre Even, Saint Sebastien sur Loire (FR)

(73) Assignee: AUMATECH, Sainte-Luce sur Loire (FR)

( * ) Notice: Subject to any disclaimer, the term of this patent is extended or adjusted under 35 U.S.C. 154(b) by 69 days.

(21) Appl. No.: 16/754,421

(22) PCT Filed: Oct. 9, 2018

(86) PCT No.: PCT/FR2018/052495
§ 371 (c)(1),
(2) Date: Aug. 31, 2020

(87) PCT Pub. No.: WO2019/073166
PCT Pub. Date: Apr. 18, 2019

(65) Prior Publication Data

US 2020/0406493 A1 Dec. 31, 2020

(30) Foreign Application Priority Data

Oct. 9, 2017 (FR) ..... 1759418

(51) Int. Cl.
*B27G 19/06* (2006.01)
*B27B 13/14* (2006.01)

(52) U.S. Cl.
CPC ..... *B27G 19/06* (2013.01); *B27B 13/14* (2013.01); *Y10T 83/088* (2015.04); *Y10T 83/707* (2015.04)

(58) Field of Classification Search
CPC ... Y10T 83/088; Y10T 83/081; Y10T 83/141; Y10T 83/707; B27G 19/06; B27G 19/00; B27B 13/14; B27B 13/00; B27B 13/10
See application file for complete search history.

(56) References Cited

U.S. PATENT DOCUMENTS

2002/0170400 A1* 11/2002 Gass ..... B27B 13/14 83/62.1
2008/0245200 A1 10/2008 Campbell
2011/0167974 A1* 7/2011 Jan ..... F16D 59/02 83/58
2011/0247472 A1* 10/2011 Dale ..... B27B 13/14 83/788
2017/0282397 A1* 10/2017 Campbell ..... F16P 3/12

FOREIGN PATENT DOCUMENTS

WO 2016041020 A1 3/2016

* cited by examiner

*Primary Examiner* — Phong H Nguyen
(74) *Attorney, Agent, or Firm* — Volpe Koenig

(57) ABSTRACT

A safety device for a bandsaw includes a frame and a pair of jaws rotatably mounted thereon. The frame is mounted on the framework of the saw with the jaws on either side of the blade. An actuating rod is slidably mounted on the frame. A resilient return member constrains the sliding and a two-way transmission transforms it into a rotation of the pair of jaws. An electromagnetic actuator is rigidly connected to the frame and a retaining member is rigidly connected to the actuator. The rod has a receiving portion which engages with the retaining member when the rod is in a first position relative to the frame. The transmission is arranged so that the jaws are separated from one another when the rod is in the first position.

15 Claims, 12 Drawing Sheets

SAFETY DEVICE FOR A BANDSAW

FIELD OF THE INVENTION

The invention relates to a safety device for a bandsaw and a bandsaw equipped with such a device.

BACKGROUND

A bandsaw is a machine tool in which a band-shaped saw blade is folded over on itself to form a loop. This loop is mounted on two flywheels mounted such that they rotate on a framework, in a mutually separated manner. The flywheels can be set to rotate to cause the loop to rotate relative to the framework.

Bandsaws are widely used in a large range of fields. Bandsaws are, for example, commonly used in the carpentry field, in particular to cut rough lumber. Saws of this type are also very often used in the butchery field, in particular to carve up meat carcasses.

Bandsaws are appreciated for their fast cut, which results from a high linear speed of the blade relative to the framework. This speed often reaches 1,800 meters per minute, and can reach as high as 2,600 meters per minute.

This high speed is accompanied by a relatively long stopping time, which can be equal to several tens of seconds. In order to reduce the time required to stop the blade, current bandsaws are generally equipped with a brake, often of the electromagnetic type, coupled to the motor.

With this type of brake, the blade stops much faster, generally in a few seconds, for example in about 3 seconds or less.

Increasing efforts are being made to improve the safety of operators working with bandsaws. In general, this involves detecting whether the operator, and especially his/her hands get too close to the blade, and, where appropriate, instructing this blade to stop.

One difficulty resides in the fact that the scope of the detection zone must be compatible with the work carried out using the saw: the detection zone must be small enough to prevent unwanted stoppages, and large enough so that the blade has enough time to stop after the stop instruction, before the operator comes into contact with the blade. The scope of the detection zone must further take into account the speed at which the operator is working. This speed can be quite high.

The few seconds that it takes to bring the blade to a complete standstill by actuating the electromagnetic brake alone require the scope of the detection zone to be expanded, which is generally incompatible with most of the operations carried out using bandsaws. The application of an electromagnetic brake begins about 50 milliseconds after being actuated and is only fully operational after about 120 milliseconds. Fully stopping the blade requires at least several hundred milliseconds. Even when contenting oneself with a braked but not stopped blade, at the time of the contact with the operator, the detection zone still remains too large for certain works: the operator occasionally works in the immediate vicinity of the blade, in particular when cutting small pieces of wood or carcass parts having small dimensions.

There is thus a need to equip bandsaws with specific safety devices, in addition to the electromagnetic brakes intended to normally stop the blade, which devices are capable of stopping the blade faster than the brakes. Such devices must be capable of stopping the blade very quickly after detecting that the operator is in the vicinity of the blade.

Depending on the performance levels thereof, the safety devices allow the detection zone to be more or less reduced.

The U.S. patent document 2008/0245200 proposes a safety device comprising a pair of toothed jaws rotatably mounted on a frame. The frame is mounted on the framework of a bandsaw such that the toothed jaws are located on either side of a blade of the saw. The toothed jaws are connected to one another by a coupling bar, which coordinates the rotation thereof relative to the frame. An actuating rod is slidably mounted on the frame, constrained by a compression spring. One end of this rod cooperates with a portion of one of the toothed jaws in the shape of a cam. The coupling bar and the cam transform a sliding of the actuating rod into a rotational and coordinated movement of the toothed jaws. The actuating rod is capable of reversibly moving between a first and a second position relative to the frame. The toothed jaws can thus be driven in rotation between a position wherein the teeth thereof are separated from one another, when the actuating rod is in the first position relative to the frame, and a position wherein the teeth thereof are engaged with one another, when the actuating rod is in the second position relative to the frame. This engagement blocks the saw blade.

The actuating rod is rigidly connected to a lug which is fixedly retained relative to the frame by means of a fuse wire, with the actuating rod in the first relative position thereof. When the presence of an operator is detected, an electric current is discharged through the wire. This melts and releases the actuating rod. The latter gains its second position under the effect of the return force of the spring.

The device of the U.S. patent document 2008/0245200 is relatively efficient: it allows the blade of the saw to be stopped very quickly. The Applicant has observed that this efficiency is a result of the presence of teeth on the jaws. By engaging with one another, these teeth suddenly and forcibly deform the blade. As a result, the blade is stopped almost instantly. However, the blade becomes unusable: it must be replaced. This results in a period of unavailability of the saw for the time required to remove the damaged blade, mount a new blade and adjust the tension thereof. This is not satisfactory, all the more so since experience shows that safety stoppages occur several times a day on the same saw.

SUMMARY

The Applicant has set itself the goal of improving this situation. For this purpose, it proposes a safety device for a bandsaw of the type comprising a frame and a pair of jaws rotatably mounted on the frame. This frame is suitable for being mounted on a bandsaw framework with the jaws disposed on either side of a blade of this bandsaw. The device further comprises an actuating rod slidably mounted on the frame, and at least one elastic return member constraining the sliding of the actuating rod. A two-way transmission transforms the sliding of the actuating rod into a rotation of the pair of jaws. The device further comprises an electromagnetic actuator rigidly connected to the frame and a retaining member rigidly connected to the electromagnetic actuator. The actuating rod is arranged with a receiving portion which is capable of engaging with the retaining member when the actuating rod is in a first position relative to the frame. The two-way transmission is arranged so that the jaws are distant from one another when the actuating rod is in this first relative position. The electromagnetic actuator maintains the engagement between the retaining member and the receiving portion as long as it is supplied with current.

The device proposed stops the blade efficiently and quickly, even in the case where the jaws are devoid of teeth. This allows the device proposed to be used without deteriorating the blade. The stopping device triggers itself in the absence of current, in particular in the event of a power cut. The device proposed is triggered more quickly: it more quickly brings about the rotation of the jaws, which can, where relevant, compensate for a potential delay linked to the use of smooth jaws rather than toothed jaws. The device proposed closes in the same angular position of the jaws, and at the same speed, unlike known devices. Unlike known devices, the performance whereof is drawn from the action of toothed jaws on the blade, the efficiency of the device proposed is drawn from a specific kinematic linkage, including the release of the actuating rod by releasing an electromagnetic actuator and an associated retaining member.

The device proposed can operate without any pneumatic element of the cylinder type, thus avoiding any difficulties linked to the provision of a gas supply. In the event of a power cut, the device proposed switches to a state wherein the jaws block the blade, or remains in such a state.

The Applicant further proposes a bandsaw comprising a framework and a blade. The saw further comprises a safety device of the type comprising a frame and a pair of jaws rotatably mounted on the frame. This frame is mounted on the framework with the jaws disposed on either side of the blade. The device further comprises an actuating rod slidably mounted on the frame, and at least one elastic return member constraining the sliding of the actuating rod. A two-way transmission transforms the sliding of the actuating rod into a rotation of the pair of jaws. The device further comprises an electromagnetic actuator rigidly connected to the frame and a retaining member rigidly connected to the electromagnetic actuator. The actuating rod is arranged with a receiving portion which is capable of engaging with the retaining member when the actuating rod is in a first position relative to the frame. The two-way transmission is arranged so that the jaws are distant from one another when the actuating rod is in this first relative position. The electromagnetic actuator maintains the engagement between the retaining member and the receiving portion as long as it is supplied with current.

BRIEF DESCRIPTION OF THE DRAWINGS

Other features and advantages of the invention will become apparent upon examining the detailed description provided hereinbelow, and from the accompanying drawings in which.

DETAILED DESCRIPTION OF THE PREFERRED EMBODIMENTS

The accompanying drawings contain elements of a certain character. They can not only be used to complement the invention, but also contribute to the definition thereof, where appropriate.

Figure 1A:
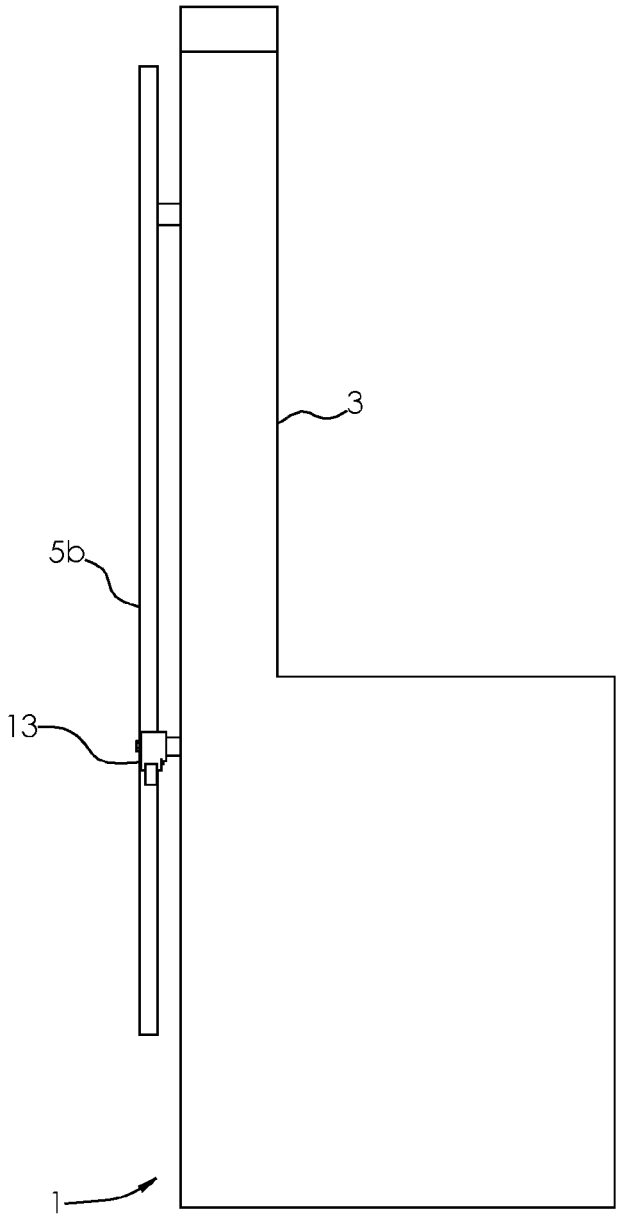
FIG. 1A shows a bandsaw from the right-hand side.
Figure 1B:
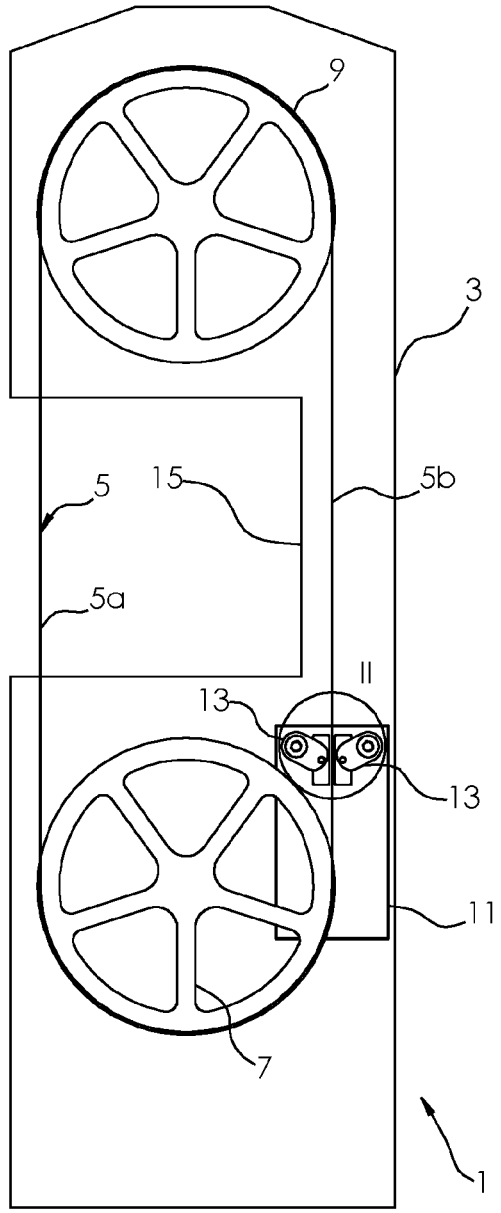
FIG. 1B shows the saw in FIG. 1A from the front.

Reference is now made to FIGS. 1A and 1B.

They show a machine tool in the form of a bandsaw 1. The saw 1 comprises a framework 3 and a blade 5 in the shape of a band. The saw 1 further comprises a first flywheel, or lower flywheel 7, and a second flywheel, or upper flywheel 9, each rotatably mounted on the framework 3, in this case in line with one another.

At least one of the lower flywheel 7 and of the upper flywheel 9 is connected to a motor capable of driving the flywheel in question such that it rotates relative to the framework 3. The motor is in particular of the synchronous type. A synchronous motor is easier to stop. More generally, the speed of synchronous-type motors is easier to control. A motor of this type can be stopped in a few seconds, for example in a time of around 3 seconds.

The blade 5 is folded over on itself so as to form a loop. This loop is mounted around the lower flywheel 7 and the upper flywheel 9.

The loop is moved by way of the motor flywheel. The other of the lower flywheel 7 and of the upper flywheel 9 is mounted loose. At least one of the lower flywheel 7 and of the upper flywheel 9 is further mounted on the framework 3 with the possibility of moving in translation towards the other of the lower flywheel 7 and of the upper flywheel 9, in this case in an essentially vertical direction, to allow the loop formed by the blade 5 to be tensioned and/or slackened.

In this case, the saw 1 comprises a safety device 11 attached to the framework 3. The safety device 11 comprises a pair of jaws 13 facing one another. The safety device 11 is positioned on the framework 3 such that the blade 5 passes between the jaws 13 and is held in this position by a set of fasteners not shown.

The framework 3 delimits a work space 15, through which vertically passes a portion of the blade 5. The rotation of the motor flywheel causes a tensioned portion, or strand, 5*a* and a slack strand 5*b* to appear in the loop of the blade 5, between the lower flywheel 7 and the upper flywheel 9.

The tensioned strand 5*a* passes through the work space 15, whereas the safety device 11 is disposed on the slack strand 5*b*.

Figure 2:
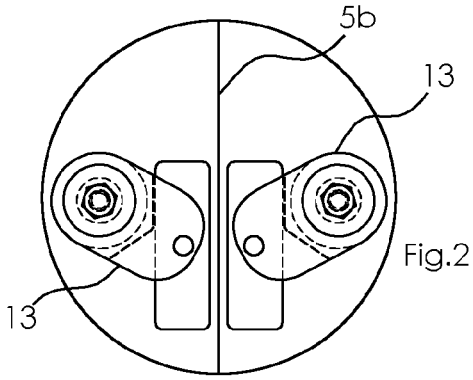
FIG. 2 shows a feature II of the saw in FIG. 1B.

Reference is now made to FIG. 2.

It shows the jaws 13 in a position wherein they are separated from one another. The jaws 13 are separated from the slack strand 5*b* of the blade 5.

Figure 3:
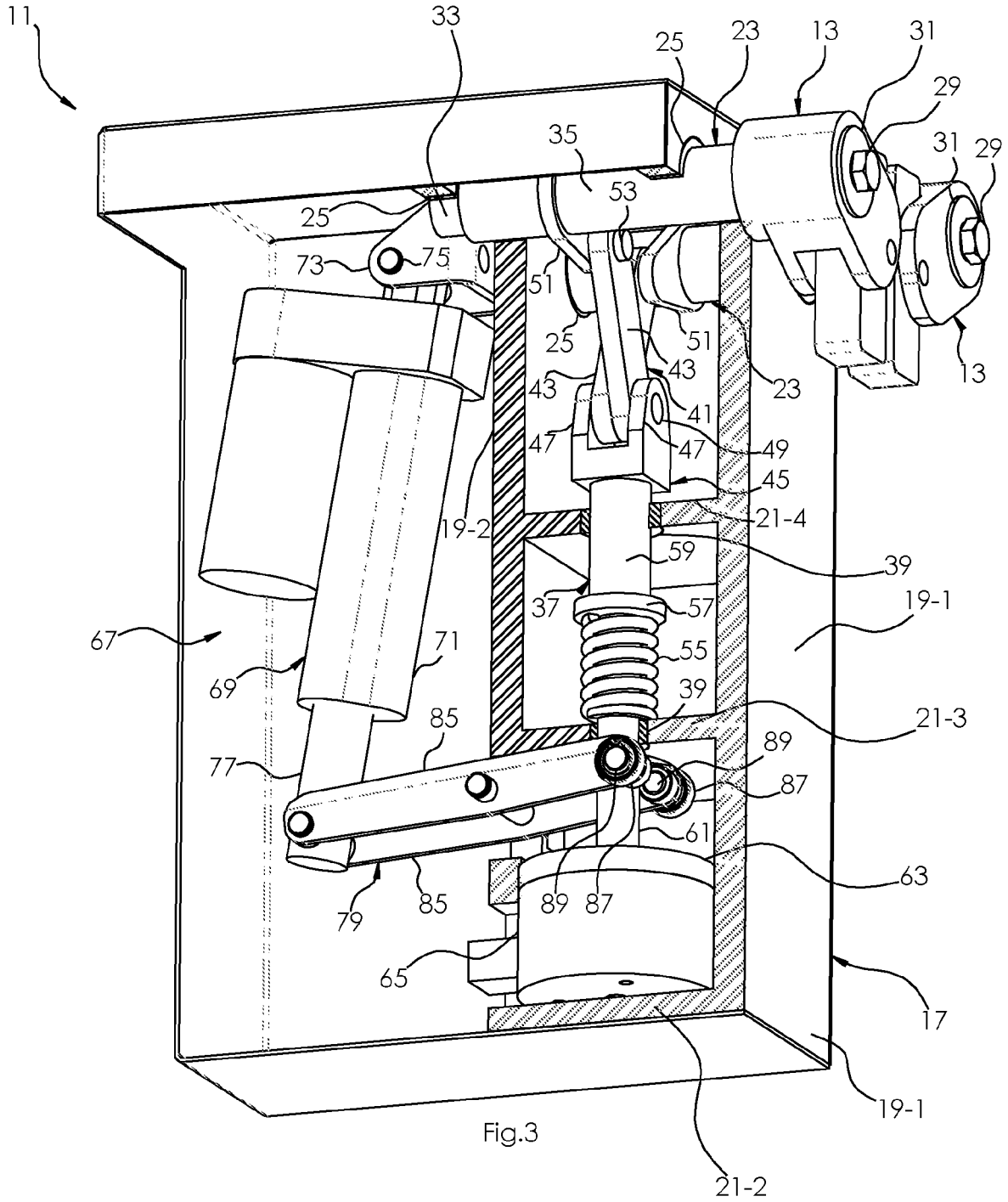
FIG. 3 shows a safety device to be used, for example, for the saw in FIGS. 1A and 1B, from a perspective, isometric, partially sectional view, in a first operating state.
Figure 4:
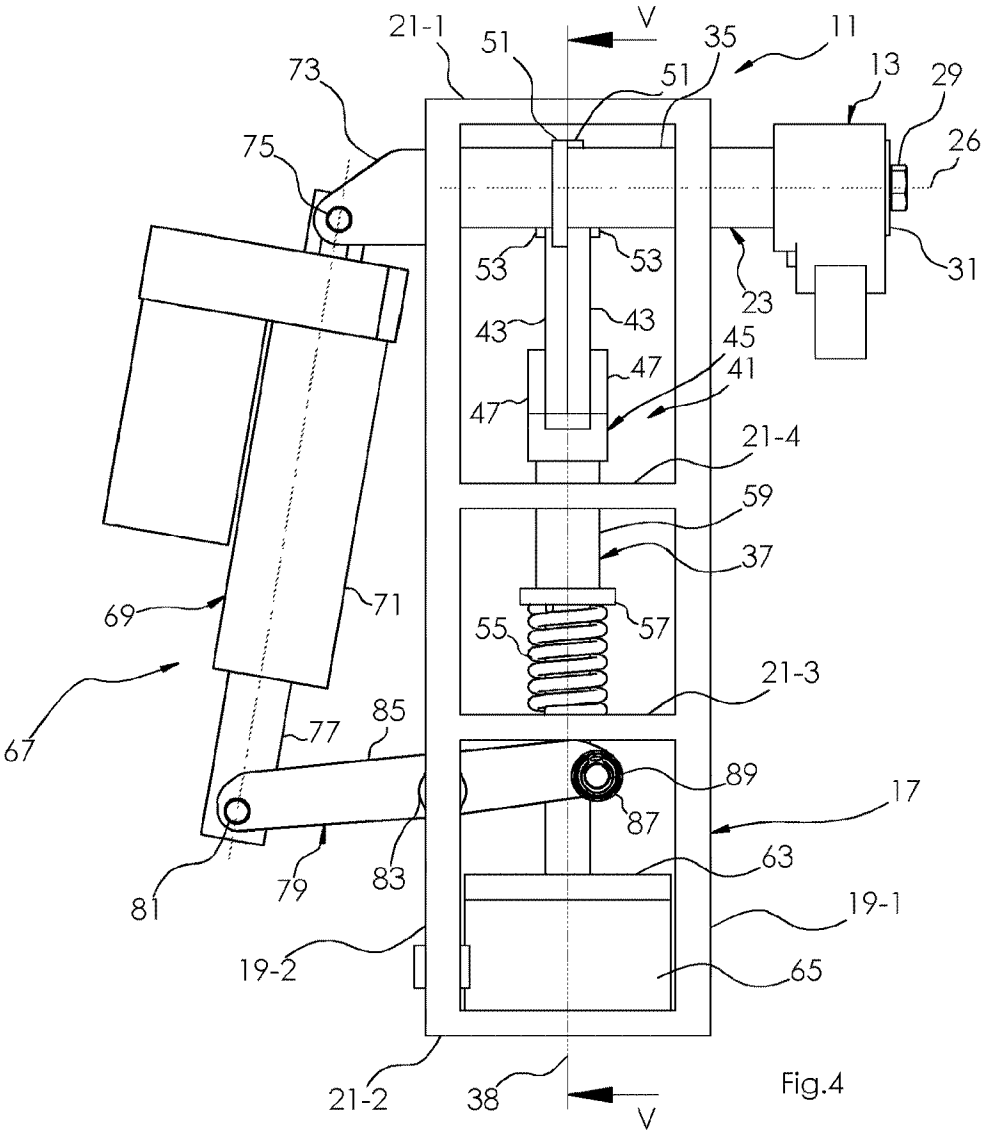
FIG. 4 shows the device in FIG. 3 from the side.
Figure 5:
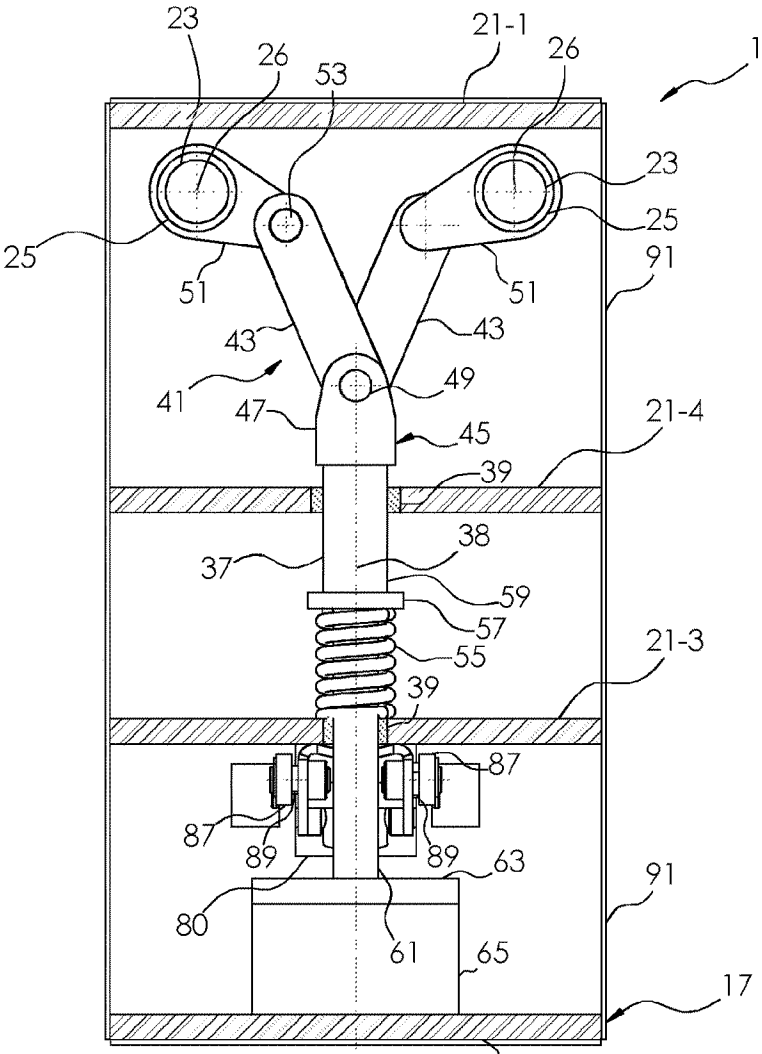
FIG. 5 shows the device in FIG. 4 via a sectional view along the line V-V.

Reference is now made to FIGS. 3 to 5.

They show the safety device 11 in the isolated state.

The safety device 11 comprises a frame 17 on which the jaws 13 are mounted, each such that they can rotate about respective axes parallel to one another. In this case, the frame 17 has a pair of flat uprights, i.e. a first flat upright 19-1 and a second flat upright 19-2. The first flat upright 19-1 and the second flat upright 19-2 are disposed facing one another, such that they extend parallel to one another. The first flat upright 19-1 and the second flat upright 19-2 are held to one another in this relative position by flat crosspieces, i.e. a first end crosspiece 21-1 which connects one of the ends of the first upright 19-1 to the corresponding end of the second upright 19-2, a second end crosspiece 21-2 which connects the other end of the first upright 19-1 to the corresponding end of the second upright 19-2, and a first 21-3 and a second 21-4 divider crosspiece each of which connects an intermediate portion of the first upright 19-1 to the corresponding portion of the second upright 19-2.

The first upright 19-1 corresponds to a front face of the safety device 11.

Each jaw 13 is mounted on a respective drive shaft 23 such that it is rigidly connected thereto, at least for rotation therewith.

Each drive shaft 23 is mounted such that it rotates on the frame 17, guided by way of a first pair of bearings, or first bearings 25, which define a respective axis 26. In this case, the first bearings 25 are made in the form of plain bearings or bushings. For each shaft 23, one first bearing 25 is housed inside the first upright 19-1 whereas the other first bearing 25 is housed inside the second upright 19-2, facing the other first bearing 25.

Each of the drive shafts 23 protrudes from the first upright 19-1 extending away from the second upright 19-2. Each of these shafts 23 projects from the frame 17. Each time, a jaw 13 is mounted on an end portion of a respective drive shaft 23, which protrudes from the first upright 19-1, or first end, by way of a corresponding orifice made in the jaw 13. This first end forms a journal adapted to cooperate with a bore made each time in a jaw 13. For example, each of these journals has a diameter of less than an adjacent portion of the respective drive shaft 23 thereof. Each jaw 13 bears against one end of this adjacent portion, which forms a shoulder. Each jaw 13 is held in this position on the respective shaft 23 thereof by a fastener, in this case comprising a screw 29 and a washer 31 clamped against a face of the jaw 13 by the screw 29.

Each drive shaft 23 has an end portion opposite the first end, or second end portion 33. In this case, the second end 33 has a reduced diameter compared to the rest of the drive shaft 23. This second end 33 is received in the first bearing 25 housed inside the second upright 19-2.

Each drive shaft 23 has an intermediate portion 35 between the second end portion 33 thereof and the opposite end portion thereof.

The safety device 11 further comprises an actuating rod 37 mounted on the frame 17 and able to move in translation in a first direction 38, normal to the rotational axes 26 of the jaws 13. The actuating rod 37 is guided in translation on the frame 17 by a second pair of bearings, or second bearings 39, in this case in the form of plain bearings or bushings. One second bearing 39 is housed inside the first intermediate crosspiece 21-3 whereas the other second bearing 39 is housed inside the second intermediate crosspiece 21-4, facing the first second bearing 39.

At one of the ends thereof, the actuating rod 37 is connected to each of the drive shafts 23 by a two-way transmission 41 which transforms the translational movement of the rod 37 relative to the frame 17 in the first direction 38 into a rotational movement of each of the drive shafts 23 about the respective axes 26 thereof. The two-way transmission 41 is arranged such that the rotational movements of the drive shafts 23 are mutually combined and occur in directions opposite one another.

In this case, the two-way transmission 41 comprises a pair of connecting rods 43, one respective end whereof, or small end, is attached to the corresponding end of the actuating rod 37 with the possibility of rotating about an axis parallel to the rotational axes 26 of the jaws 13.

The corresponding end portion of the actuating rod 37 is shaped as a stirrup 45 including two yokes 47 which extend parallel to one another. Each of these yokes 47 is perforated by a respective orifice. The orifices of the yokes 47 and the corresponding orifices in the small ends of the connecting rods 43 are crossed by the same shaft, forming a pin 49. The pin 49 is forcibly fitted into the orifices of the yokes 47 whereas each of the connecting rods 43 are free to pivot about this pin 49.

The two-way transmission 41 further comprises a pair of cranks 51 each attached to a respective drive shaft 23 and to a big end portion of a respective connecting rod 43, opposite the small end portion.

The cranks 51 each have a first orifice via which the crank 51 is mounted on a respective drive shaft 23. The cranks 51 each have a second orifice, opposite the first, which receives a trunnion 53 also received in a corresponding orifice of a respective connecting rod 43.

The translational movement of the actuating rod 37 relative to the frame 17 is constrained by an elastic return member, in this case in the form of a spring 55 loaded by compression. In this case, the spring 55 is of the helical type.

The actuating rod 37 is produced, in this case, in the form of a shaft having a circular section. The actuating rod 37 has in particular a shoulder portion 57 and a first junction portion 59 which connects the stirrup 45 to the shoulder portion 57. The actuating rod 37 further comprises a second junction portion 61 which connects one end of the actuating rod 37 opposite the stirrup 45 to the shoulder portion 57.

The first junction portion 59 is received in the second bearing 39 housed inside the second intermediate crosspiece 21-4. The second junction portion 61 passes through the second bearing 39 housed inside the first intermediate crosspiece 21-3.

A longitudinal end of the spring 55 in this case bears against a large face of the first intermediate crosspiece 21-3, whereas an opposite end of the spring 55 bears against the shoulder portion 57 of the actuating rod 37.

The end of the actuating rod 37 opposite the stirrup 45 carries a backplate 63 capable of cooperating with an actuator, in this case in the form of an electromagnetic lock 65 fixedly held in place relative to the frame 17. The lock 65 includes a magnet (not shown), which forms a retaining member rigidly connected to the lock 65. The backplate 63 forms a portion for receiving the actuating rod 37. This receiving portion is capable of engaging with the magnet of the lock 65.

In this case, the lock 65 is fastened to a large face of the second end crosspiece 21-2.

The safety device 11 is in a first operating state so-called open. In the open state, the actuating rod 37 is located in a first position relative to the frame 17, wherein the backplate 63 is engaged with the magnet of the lock 65. The backplate 63 is located against the magnet of this lock 65. The shoulder portion 57 of the actuating rod 37 is close to the first intermediate crosspiece 21-3. The spring 55 is compressed between this shoulder portion 57 and this first intermediate crosspiece 21-3. The actuating rod 37 is retained relative to the frame 17, in this first position, by the action of the magnet of the lock 65 on the backplate 63, provided that the lock 65 is supplied with current. The actuating rod 37 is engaged with the lock 65. The jaws 13, or at least one active portion thereof, are separated from one another. The separation between the jaws 13 allows a saw blade to pass, such as the blade 5 in FIGS. 1A, 1B and 2.

The safety device 11 is armed.

In this case, the safety device 11 comprises an optional arming system 67.

The arming system 67 includes an actuator, in this case in the form of a cylinder 69 of the electric type, the body 71 whereof is fastened to the frame 17 by way of a fastening yoke 73 and a second trunnion 75 housed therein and passing through an end part of the body 71. The fastening yoke 73 is attached, in this case, against a large face of the second upright 19-2 opposite the first upright 19-1. In this case, the cylinder 69 is of the trapezoidal screw cylinder type, such that the rod 77 of the cylinder 69 remains unmoving relative to the body 71 of this cylinder 69 provided that the motor of this cylinder 69 is not rotating.

The rod 77 of the cylinder 69 supports an arm 79 hinged at one of the ends thereof to the rod 77 about a third trunnion 81. The arm 79 is moreover hinged to the frame 17 about a fourth trunnion 83 housed inside the frame 17, in this case in the second upright 19-2.

In this case, the arm 79 includes a pair of extended flanges 85 which extend parallel to one another and are held in this position by the third trunnion 81 and the fourth trunnion 83. The arm 79 is disposed such that the actuating rod 37 is partially located between these flanges 85 on a part of the second junction portion 61 thereof.

The arm 79 passes through the second upright 19-2 via a slot 80 made in a large face thereof. The end of the arm 79 opposite the rod 77 of the cylinder 69 ends between the backplate 63 and a large face of the first intermediate crosspiece 21-3. In the vicinity of this end, the arm 79 carries a pair of contact rollers 87, each mounted such that it rotates on a respective flange 85 of the arm 79 by a fourth trunnion 89.

In the first operating state of the safety device 11, the rod 77 of the cylinder 69 is deployed, and the arm 79 is located in a first position relative to the frame 17, wherein the end thereof carrying the rollers 87 is distant from the backplate 63.

The safety device 11 is enclosed inside a closed casing 91, in this case shown to be partially notched. The casing 91 bears in this case against the first upright 19-1, the first end crosspiece 21-1 and the second end crosspiece 21-2.

Figure 6:
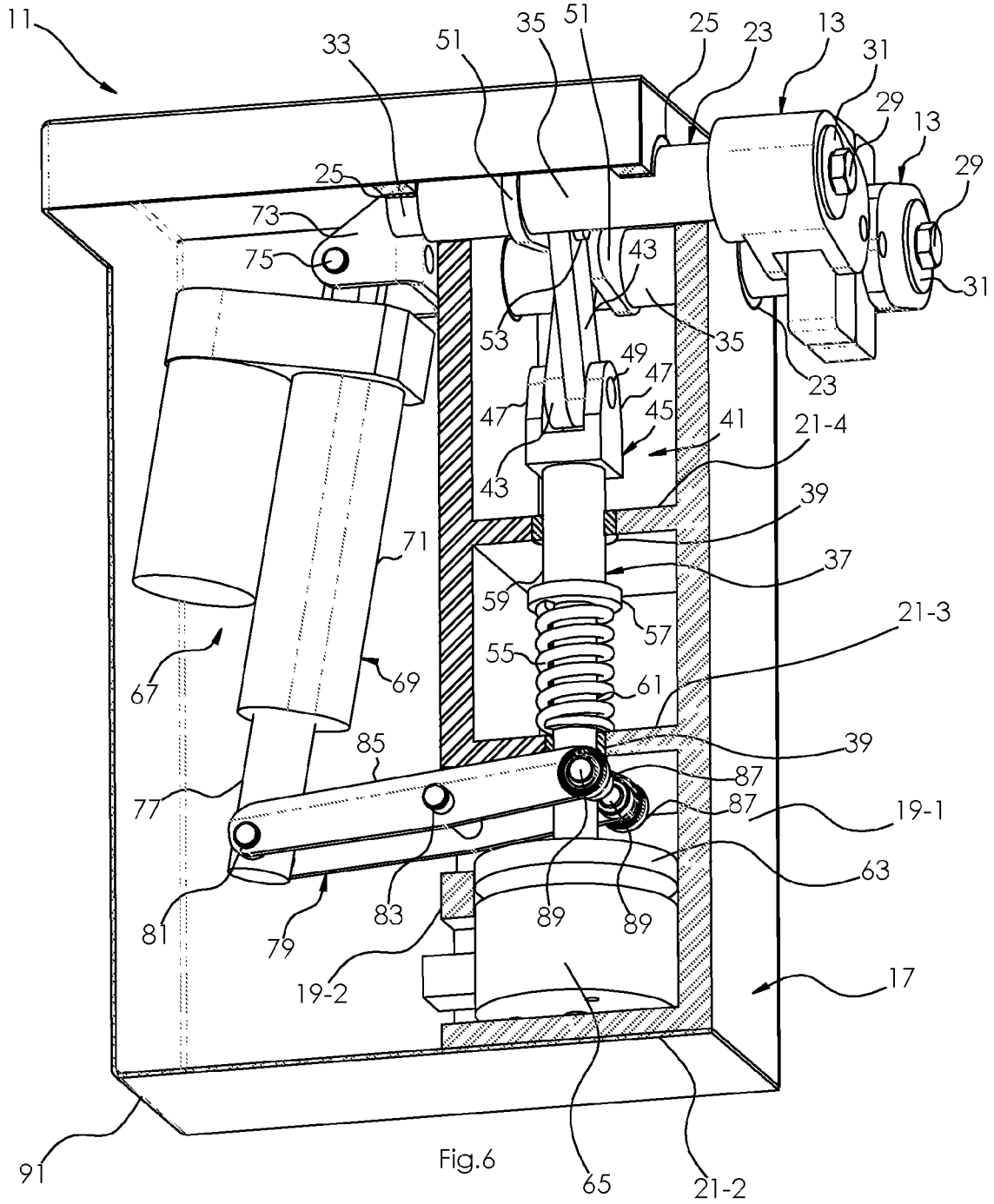
FIGS. 6 to 8 are similar views to those of FIGS. 3 to 5, respectively, with the safety device being in a second operating state.
Figure 7:
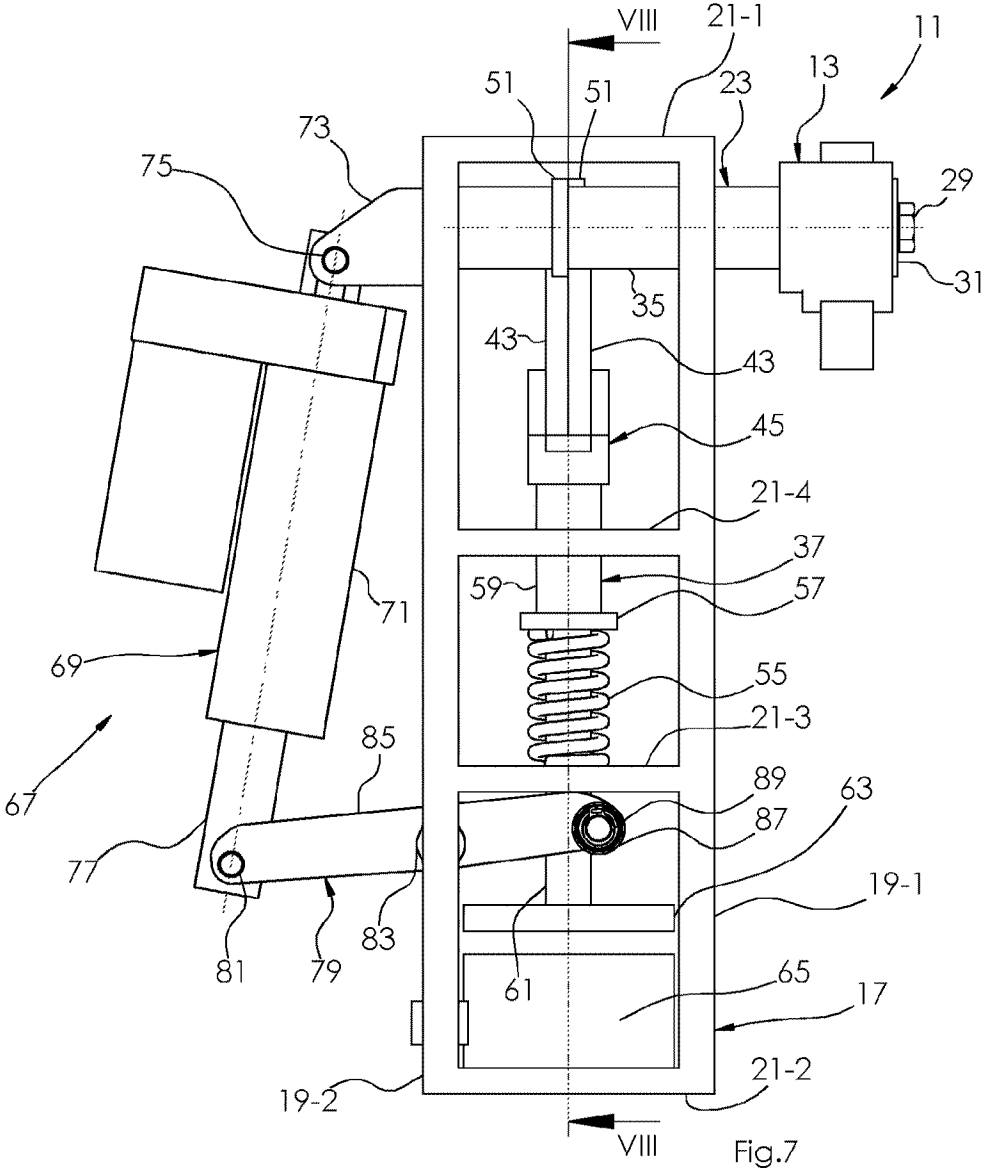
Figure 8:
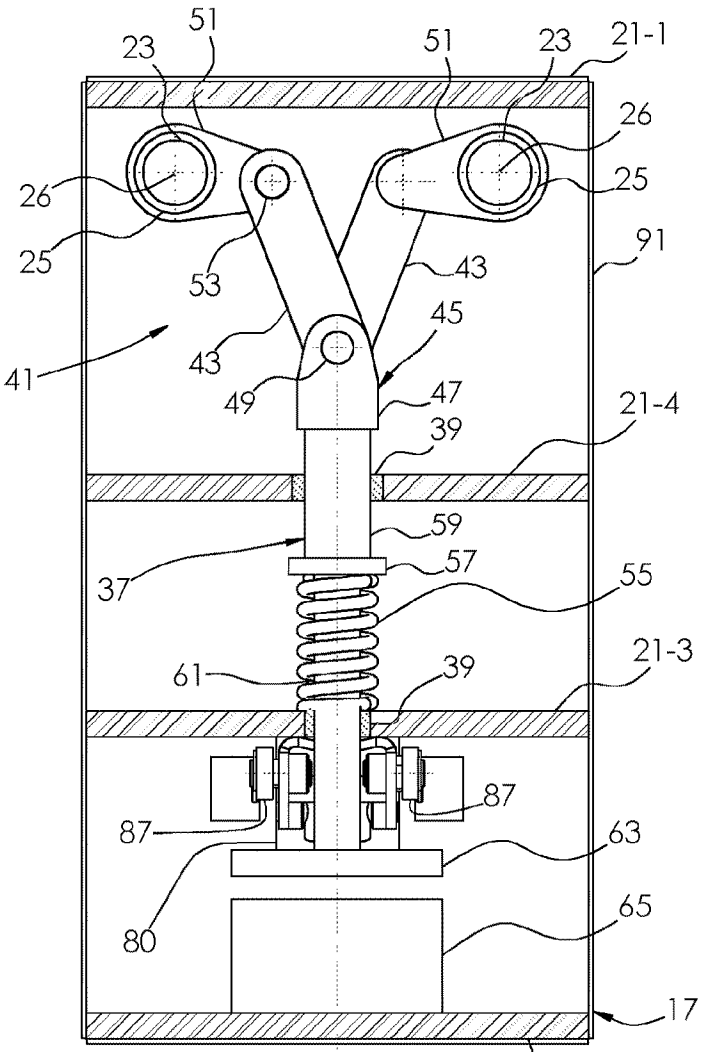

Reference is now made to FIGS. 6 to 8.

The safety device 11 is in a second operating state so-called closed. In the closed state, the actuating rod 37 is located in a second position relative to the frame 17, wherein the backplate 63 is distant from the lock 65. The shoulder portion 57 of the actuating rod 37 is distant from the first intermediate crosspiece 21-3. The spring 55 is less compressed than when the actuating rod 37 is located in the first position relative to the frame 17. The actuating rod 37 is no longer engaged with the lock 65. The jaws 13, or at least one active portion thereof, are close to one another. The separation distance between the jaws 13 is such that a saw blade becomes blocked therebetween, typically the blade 5 in FIGS. 1A, 1B and 2.

The arm 79 is located in the first position thereof relative to the frame 17.

The passage from the open state to the closed state is caused by cutting off the power supply to the lock 65. The backplate 63, rigidly connected to the actuating rod 37, is no longer retained by the lock 65. The actuating rod 37 is no longer engaged with the lock 65. It leaves the first position thereof relative to the frame 17 under the effect of a return force of the spring 55 which expands. The spring 55 displaces the actuating rod 37 via a translational movement relative to the frame 17. The two-way transmission 41 transforms this translation of the actuating rod 37 into a combined rotation of the jaws 13 relative to the frame 17. This rotation brings the jaws 13 closer to one another, at least as regards an active part thereof.

The spring 55 exerts a push force on the actuating rod 37, which transforms into a clamping force of these jaws 13 against a saw blade. The force of the spring 55 is increased by a leverage resulting from the arrangement of the connecting rods 43 and the cranks 51. The two-way transmission 41 thus includes a leverage arrangement, adapted to act on each of the jaws 13. For the same clamping force of the jaws 13, a lesser force must be generated on the spring 55 as a result of the cranks 51. In return, a less powerful lock 65 can be used, which allows the backplate 63 to be released more quickly. A lesser force on the spring 55 allows, for example, a less stiff spring to be used, while retaining the same travel of the actuating rod 37 relative to the frame 17.

Figure 9:
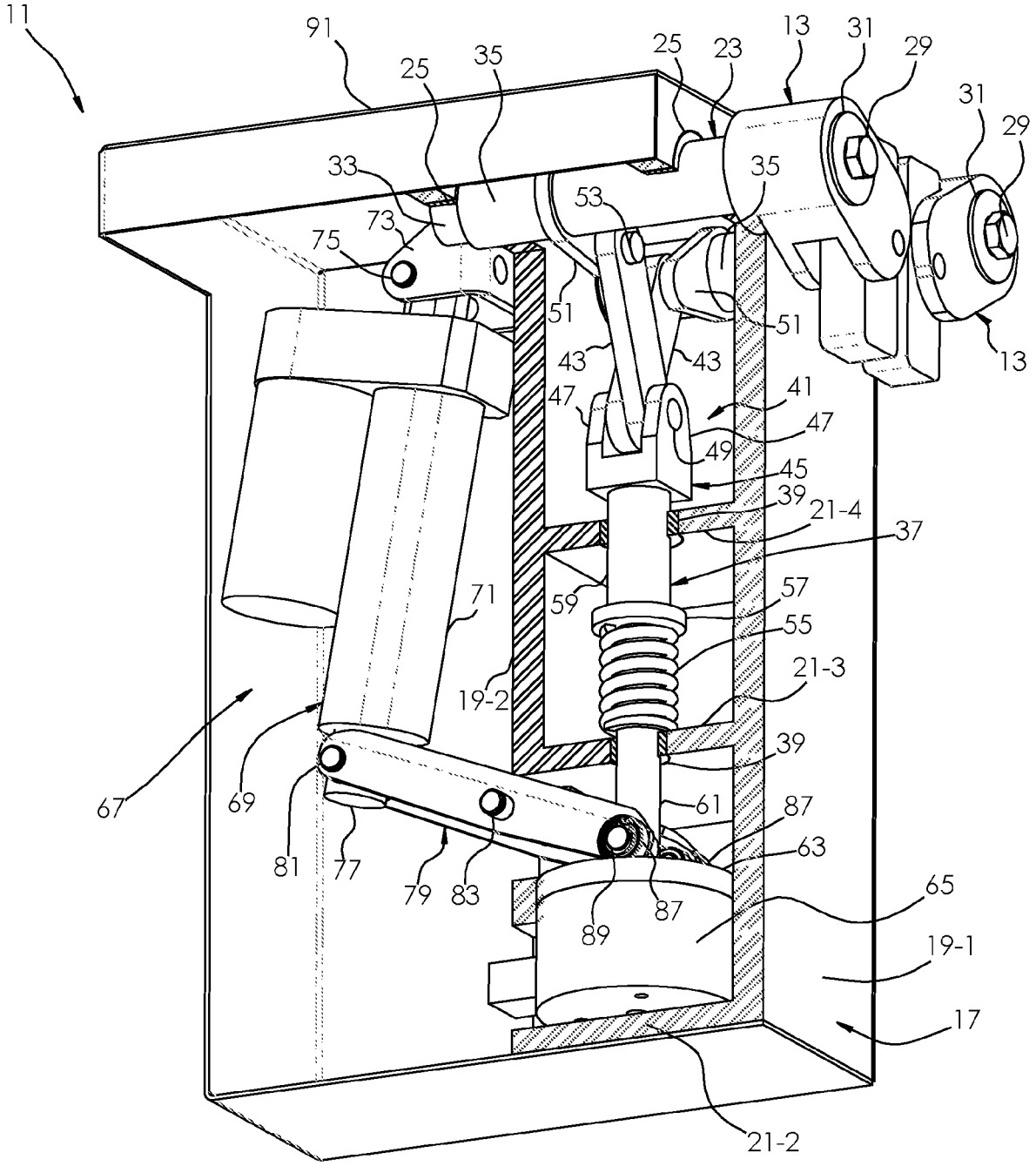
FIGS. 9 to 11 are similar views to those of FIGS. 6 to 8, respectively, with the safety device being in a third operating state.
Figure 10:
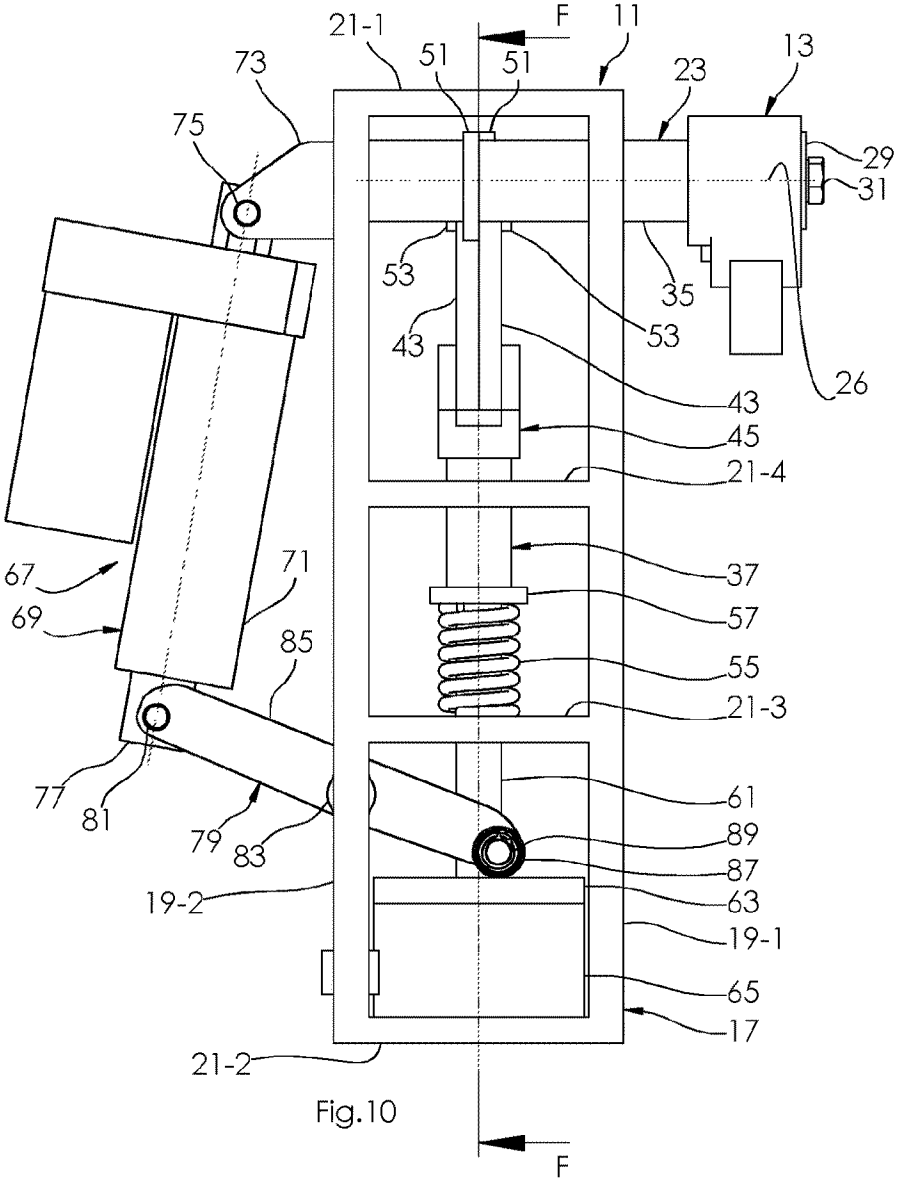
Figure 11:
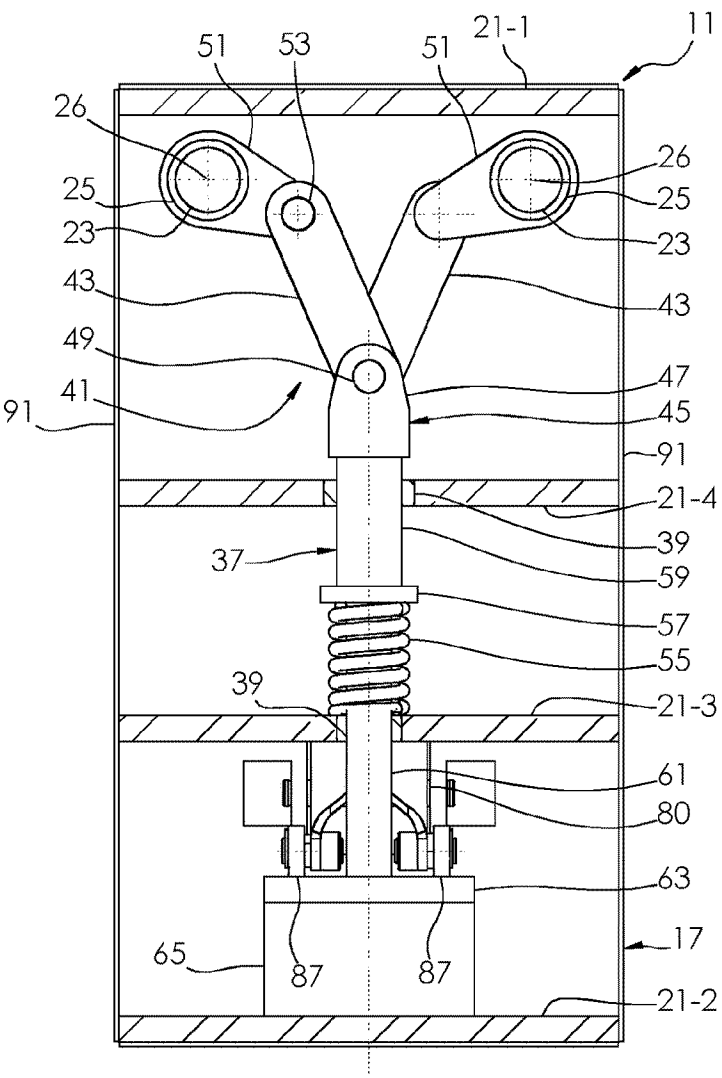

Reference is now made to FIGS. 9 to 11.

The safety device 11 is in a third transient rearming operating state.

In the rearming state, the actuating rod 37 is once again located in the first position thereof relative to the frame 17.

The arm 79 is located in a second position relative to the frame 17, wherein the rollers 87 come into contact with the backplate 63. The rod 77 of the cylinder 69 is retracted. It causes the backplate 63 to be pushed towards the lock 65 by way of the arm 79.

In order to pass from the closed state to the rearming state, the cylinder 69 is actuated such that the rod 77 retracts into the body 71. This movement of the rod 77 causes the arm 79 to pivot relative to the frame 17 about the fourth trunnion 83. This pivoting brings the arm 79 firstly into contact with the backplate 63 by way of the rollers 87, then causes this backplate 63 to be pushed towards the lock 65. This pushing takes place against the spring 55, which becomes increasingly compressed as the backplate 63 moves closer to the lock 65. Finally, the backplate 63 comes into contact with the lock 65, and the actuating rod 37 has regained the first position thereof relative to the frame 17. The lock 65 when supplied with current retains the backplate 63 and the actuating rod 37, to which the backplate 63 is rigidly connected.

The passage to the open state takes place by actuating the cylinder 69 such that the rod 77 is deployed once again. The end of the arm 79 which carries the rollers 87 moves away from the backplate 63 by the pivoting of this arm 79 on the frame 17. The backplate 63 remains held in place by the lock 65.

Figure 12:
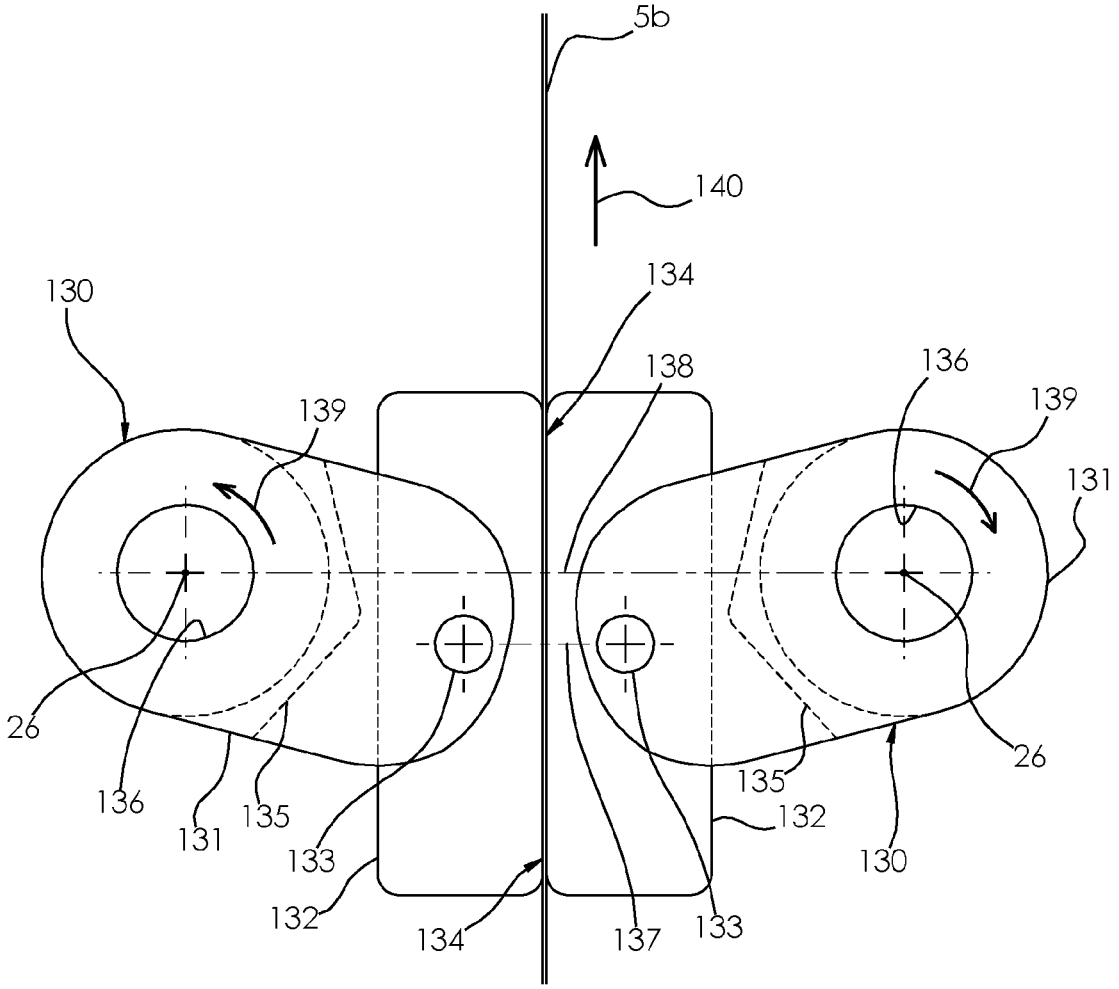
FIG. 12 shows a pair of jaws to be used, for example, for the safety device in FIGS. 3 to 11.

Reference is now made to FIG. 12.

It shows a pair of jaws 130 to be used, for example, with the safety device 11 in FIGS. 3 to 11.

Each jaw 130 comprises a body 131 and a grip jaw 132 mounted such that it pivots on the body 131, in this case via a fifth trunnion 133.

Each grip jaw 132 carries an active surface 134. The active surfaces 134 of the jaws 130 are intended to come to face one another. These active surfaces 134 are smooth. In particular, these active surfaces 134 are devoid of teeth. These active surfaces 134 are, in this case, planar as a whole. These active surfaces 134 allow a clamping force to be distributed over a blade, typically the blade 5 in FIG. 1A to 2.

In this case, each grip jaw 132 is made in one piece, having the overall shape of a rectangular parallelepiped, one face whereof forms the active surface 134. In this case, each body 131 has an oblong profile and a groove in the form of a mortise 135 open at one end of the body 131. The mortise 135 is arranged so as to receive a respective grip jaw 132, while allowing this grip jaw 132 to undergo an angular displacement relative to the body 131, for example in the order of 60 degrees.

In this case, each body 131 has a longitudinal plane of symmetry. The mortise 135 has a bottom with two surfaces which extend in an oblique and symmetrical manner relative to the plane of symmetry of the body 131 and meet at an apex. An orifice for a fifth respective trunnion 133 is made in each body 131. The central axis of this orifice is located in the plane of symmetry of the body 131. This arrangement of the bottom of the mortise 135 allows two identical bodies 131 to be used to produce the jaws 130.

Each grip jaw 132 is perforated with a respective orifice for the fifth trunnion 133. This orifice is separate from the center of gravity of the grip jaw 132. Each grip jaw 132 hangs relative to a respective body 131.

At the opposite end to the mortise 135, each body 131 has a bore 136 via which the body is mounted on a shaft, typically the drive shaft 23 in FIGS. 3 to 11. The central axis of the bore 136 lies in the plane of symmetry of the body 131.

In the open position, as shown here, the active surfaces 134 of the grip jaws 132 are distant from one another so as to allow a blade to pass, typically the slack strand 5*b* in FIGS. 1A and 1B.

The pivot centers of the grip jaws 132 on the respective body 131 thereof, which substantially correspond to an intersection of the longitudinal axis of the fifth trunnions 133 with a transverse plane of the bodies 131, can be connected to one another by a first virtual straight line 137.

The pivot centers of the bodies 131 on the frame of a safety device, typically the frame 17 described with reference to FIGS. 3 to 11, which correspond to an intersection of the longitudinal axis of the bore 136 and a transverse plane of the body 131, can be connected to one another by a second virtual straight line 138.

When the jaws 130 are located in the open relative position, as shown in FIG. 12, the first virtual straight line 137 and the second virtual straight line 138 extend as a whole parallel to one another. The first virtual straight line 137 and the second virtual straight line 138 are moreover distant from one another by several millimeters, in this case close to ten millimeters.

First arrows 139 indicate the respective directions of rotation of the jaws 130 in the closing phase. A second arrow 140 indicates the direction of travel of the slack strand 5*b*. With regard to this direction of travel 140 of the blade, the first straight line 137 is located upstream of the second virtual straight line 138, with reference to the respective directions of rotation 139 of the jaws 130.

When closing the jaws 130, the first straight line 137 is still located upstream of the second straight line 138, but in the vicinity thereof. This proximity reduces the risk of the grip jaws 132 rebounding off of one another during closing. Moreover, the closer the first straight line 137 is to the second straight line 138, the higher the pressure force applied by the jaws 130 on the blade 5.

The relative position of the first straight line 137 and of the second straight line 138 during closing contributes to maintaining this closing of the jaws 130, by producing a resultant force which contributes to the clamping. The small separation distance between the grip jaws 132 in the open position reduces the closing stroke, and thus the span of the rotation of the jaws 130. This stroke further reduces the risk of the grip jaws 132 rebounding off of one another during closing. This stroke further corresponds to the extension of the spring 55 between the first position and the second position of the safety device 11.

The production of the jaws 130 in this way allows for efficient and fast braking of a blade, without deteriorating the latter. The braking efficiency in particular results from the absence of any rebound of the active surfaces 134 against one another when closing the jaws 130. This absence of rebound is in particular the result of the shaping of the active surfaces 134 and of the low rotary travel of the bodies 131. The force to be generated by the spring 55 is also reduced since the forwards movement of the blade contributes to the clamping of the jaws 130. A lesser force at the spring 55 allows the electromagnetic actuator to have smaller dimensions.

The two-way transmission 41 produced from pairs formed by connecting rods and cranks produces a low angular displacement of the jaws 130 between the open position thereof and the closed position thereof. This low displacement contributes to obtaining a contact between the jaws 130 and the blade which always occurs in the axis of the blade and to reducing the risk of rebound.

Figure 13:
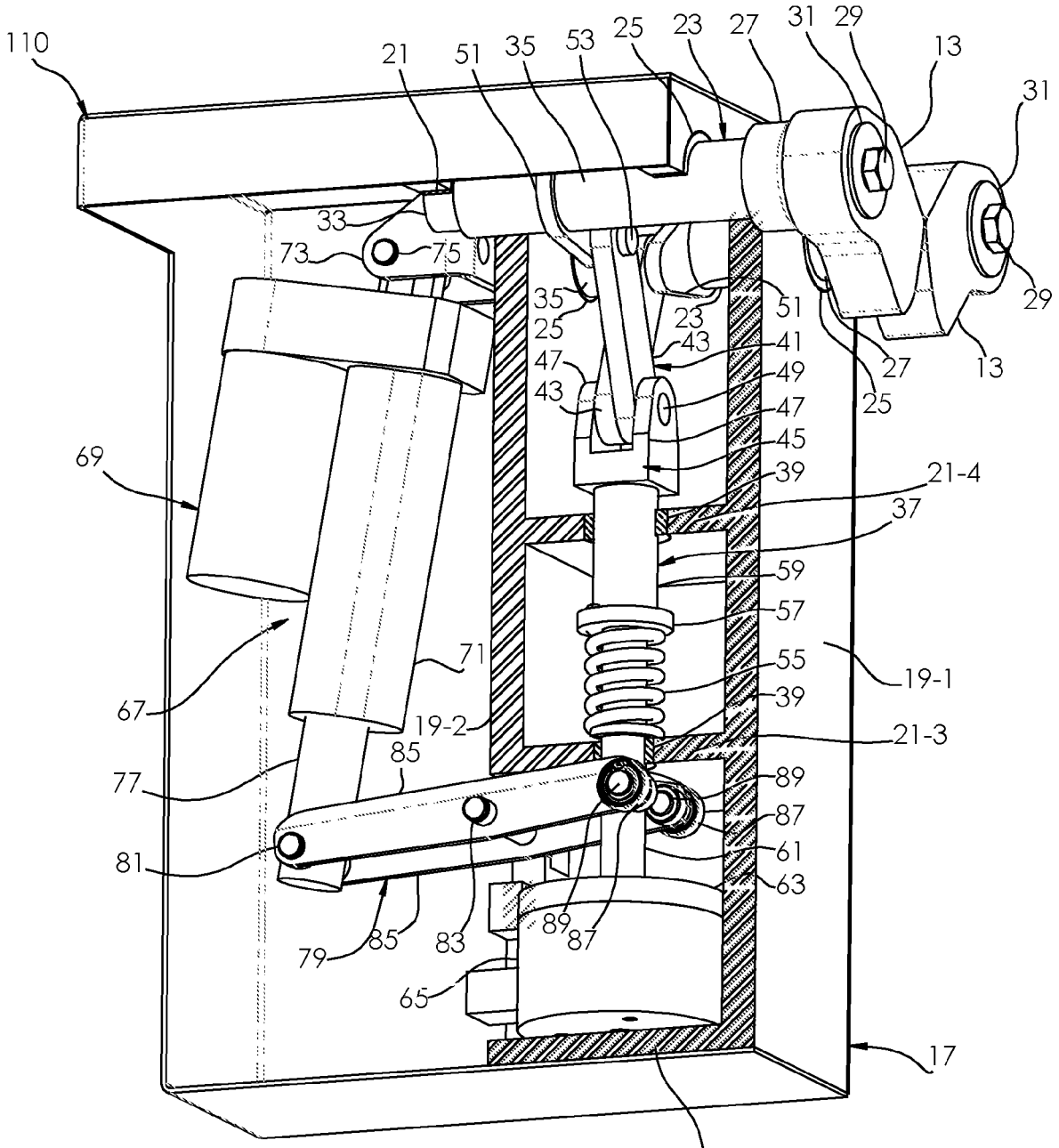
FIG. 13 shows an alternative embodiment of the safety device in FIGS. 3 to 11, in a view similar to that of FIG. 3.

Reference is now made to FIG. 13.

It shows a second safety device 110 in particular to be used with the bandsaw 1 in FIGS. 1A and 1B.

The second safety device 110 is similar to the safety device 11 described with reference to FIGS. 3 to 11, with the following exceptions (identical reference numerals denote structurally and/or functionally similar elements):

each drive shaft 23 has an end portion not given a reference numeral and a shoulder portion 27 adjacent to the end portion;

each jaw 13 bears against the shoulder portion 27 of the respective drive shaft 23 thereof and is held in this position by a respective fastener, comprising the screw 29 and the washer 31 clamped against a face of the jaw 13 by the screw 29.

Figure 14:
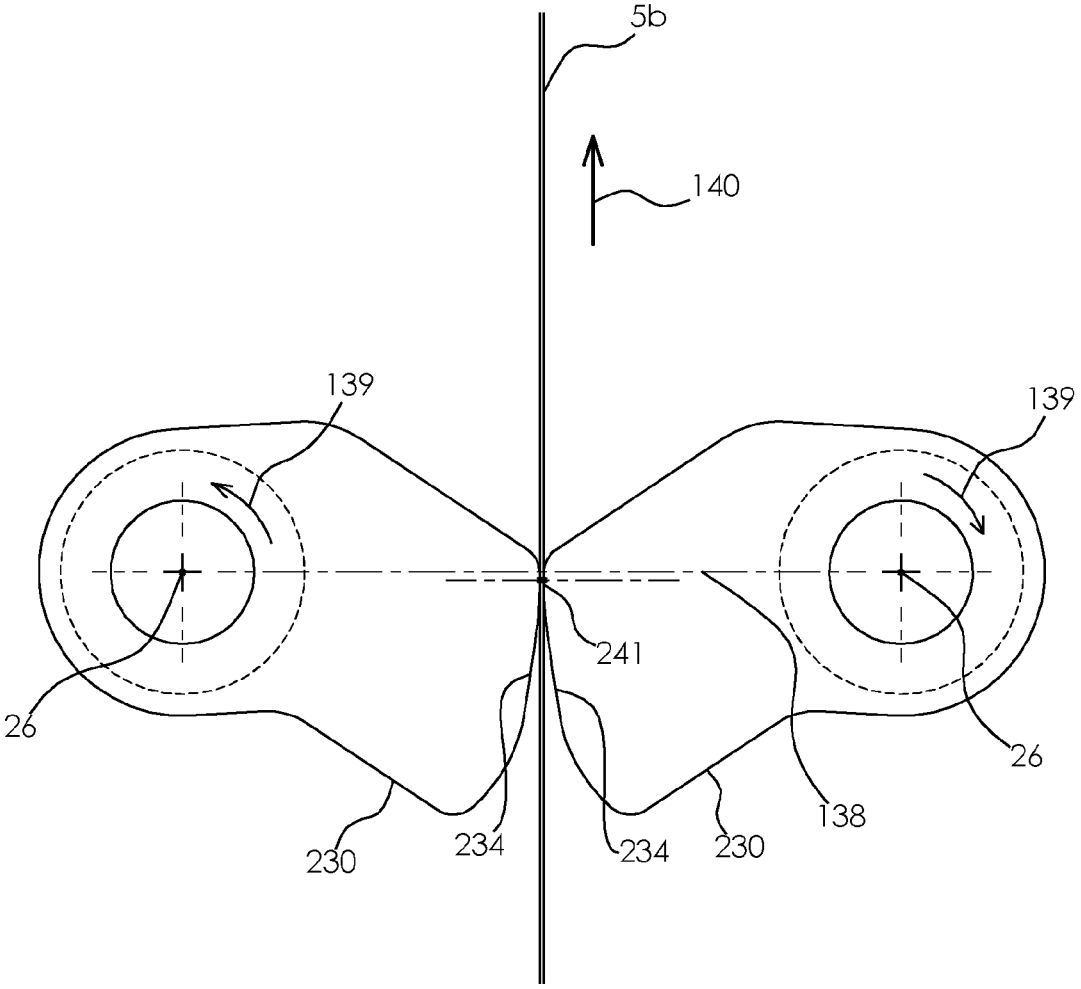
FIG. 14 shows an alternative embodiment of the pair of jaws in FIG. 12, in a view similar to that of FIG. 12.

Reference is now made to FIG. 14.

It shows a pair of jaws of a second type, or second pair of jaws 230 to be used, for example, with the safety device 11 in FIGS. 3 to 11 or the second safety device 110 in FIG. 13.

The second jaws 230 are extruded. From a profile view, each second jaw 230 has a curved edge carrying an active surface 234. The active surfaces 234 of the second jaws 230 are intended to come to face one another. These active surfaces 234 are smooth. In particular, these active surfaces 234 are devoid of teeth.

The profile of the active surfaces 234 is such that a contact area 241 with a saw blade, typically the slack strand 5*b* in FIGS. 1A and 1B, is practically isolated. This contact area 241 is moreover slightly offset from the second virtual straight line 138 which connects the centers of rotation corresponding to the intersection of the rotational axes 26 with the profile of the second jaws 230.

The profile of the second jaws 230 is arranged such that the active part of the active surfaces 234 of these second jaws 230, formed by the contact area 241, is located further ahead relative to the second virtual straight line 138, with reference to the directions of rotation of the second jaws 230. The offset can be measured in millimeters, in this case 2 millimeters for example.

The first arrows 139 indicate the respective directions of rotation of the second jaws 230 in the closing phase. The second arrow 140 indicates the direction of travel of the slack strand 5*b*. With regard to these directions of travel, the contact area 241 is located before the second virtual straight line 138. The remaining active surfaces 234 are shaped such that the contact between the active surfaces 234 of the second jaws 230 with the blade is always offset by the same distance relative to the second virtual straight line 138, regardless of the thickness of the blade 5. The active surfaces 234 are in the form of a snail-shaped curve.

This procures efficient and fast braking of the blade, without the deterioration thereof. This efficient braking in particular results from the absence of any rebound of the active surfaces 234 against one another during the closing operation, in particular caused by the shaping of the active surfaces 234. The force to be generated by the spring 55 is also reduced since the forwards movement of the blade contributes to the clamping of the second jaws 230. A lesser force allows the electromagnetic actuator to have smaller dimensions.

Figure 15:
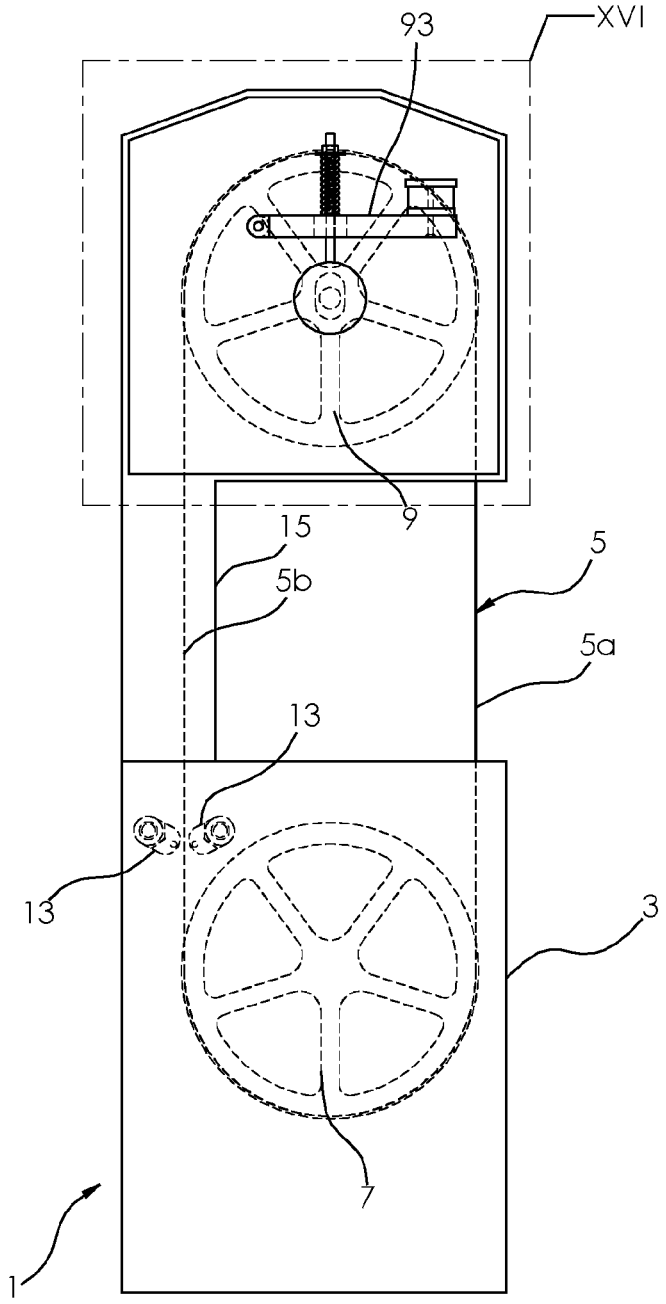
FIG. 15 shows the saw in FIGS. 1A and 1B, via a rear view.

Reference is now made to FIG. 15.

In this case, the saw 1 comprises a disengaging system 93 via which at least one of the lower flywheel 7 and of the upper flywheel 9 is mounted on the framework 3 of the saw 1. In this case, the disengaging system 93 is joined to that of the lower flywheel 7 and of the upper flywheel 9, which is mounted loose on the framework 3, for example the upper flywheel 9.

The disengaging system 93 can be actuated so as to release the tension from the blade 5, simultaneously with the triggering of a safety device. The blade 5 can thus slide relative to the lower flywheel 7 and the upper flywheel 9, such that the blade 5 stops before these flywheels. Since the actuation of the disengaging system 93 and of the safety device is simultaneous, the forces to be applied to the blade 5 to stop same are also limited.

Figure 16:
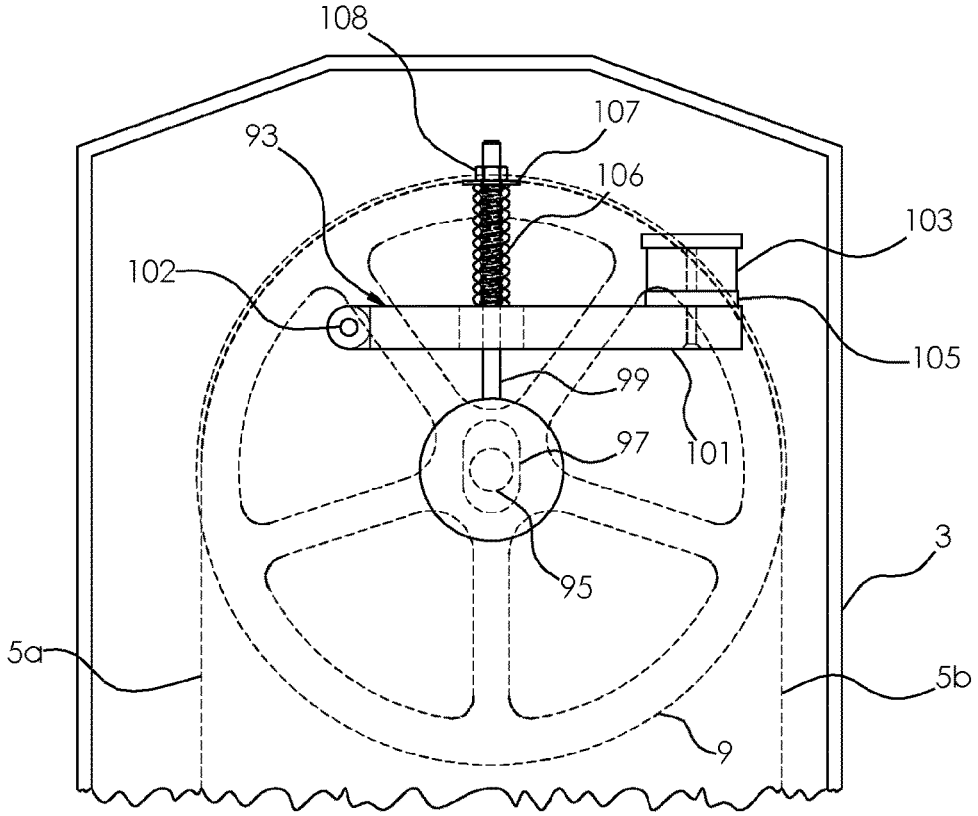
FIG. 16 shows a feature XVI of the saw in FIG. 15, with this saw being in a first operating state.

Reference is now made to FIG. 16.

The upper flywheel 9 is mounted such that it rotates on a support shaft 95, by way of a hub 97.

The disengaging system 93 comprises a main rod 99 via which the hub 97 is supported on the framework 3. The disengaging system 93 further comprises a second arm 101 hinged on the framework 3, in this case thanks to a pivot 102 disposed at one end of the second arm 101. The system 93 further comprises a second electromagnetic lock 103 fastened to the framework 3 and a second backplate 105, capable of cooperating with the second lock 103. This second backplate 105 is fastened to one end of the second arm 101 opposite the pivot 102. The second backplate 105 is engaged inside the second lock 103. As long as it is supplied with current, the second lock 103 holds the backplate 105 in this state of engagement.

The main rod 99 is supported on the framework 3 by the second arm 101, stressed by an elastic return member, in this case in the form of a second spring 106, for example a helical spring loaded by compression. One end of the second spring 106 bears against a face of the second arm 101, whereas an opposite end bears against a washer 107 stopped from moving in translation relative to the main rod 99 by a nut 108. The nut 108 is engaged on a threaded portion of the main rod 99. The tension of the blade 5 depends on the compressive state of the second spring 106. This tension can be adjusted by acting on the nut 108.

Figure 17:
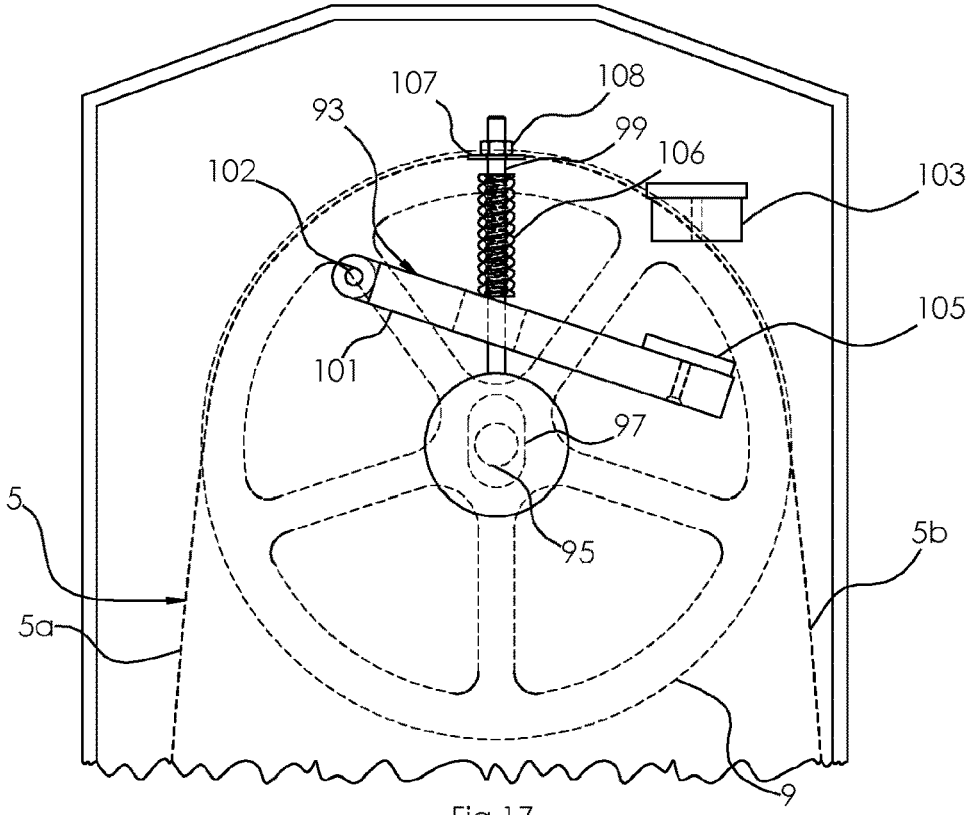
FIG. 17 shows the feature XVI of FIG. 16, with the saw being in a second operating state.

Reference is now made to FIG. 17.

Unlike in the state shown in FIG. 16, the second lock 103 is no longer supplied with current. The lock 123 no longer maintains the engagement between the backplate 105 and the lock 103. Under the effect of a return force of the second spring 106, the second arm 101 pivots about the pivot 102. The main rod 99 accompanies this pivoting by moving in translation relative to the framework 3. The blade 5 is slackened.

The disengaging system 93 and the safety device are preferably connected to the same power supply such that a power cut simultaneously triggers the actuation of the safety device and of the disengaging system. This results in a combined effect as a consequence of a lower tension in the blade to be stopped.

The device proposed is not limited to the example embodiment described, however encompasses all alternative embodiments that a person skilled in the art could consider. In particular:

The lock 65 is one example of an electromagnetic actuator. Other embodiments of this actuator can be considered. In particular, a motor and a finger rigidly connected thereto as a retaining member can be provided. A part of the actuating rod is arranged so as to receive one end of the finger, for example with a groove. When electrically powered, the torque of the motor holds the finger inside the groove. In the absence of current, the actuating rod is returned by the elastic member and this return movement causes the finger to leave the groove. The motor can act in a reverse manner by returning the finger to the groove, against the elastic return member. The motor thus also acts as a rearming system.

The spring 55 can be replaced by one or more elastic return members of a different type. For example, to replace or supplement the spring 55, a pair of torsion springs can be provided, each arranged between a respective drive shaft 23 and the frame 17.

The two-way transmission 41 can comprise a rack and a pair of pinions rigidly connected to the drive shafts 23. Each of these pinions engage on this rack or a first on this rack and the other on the first. More generally, the rotary movements of the drive shafts 23 can be mutually synchronized, for example by a gear or rack-and-pinion.

The safety device can be equipped with one or more position sensors disposed so as to determine whether the actuating rod 37 is located in the first position thereof. Control electronics can be configured so as to prevent the start-up of a saw when the actuating rod 37 is not located in the first position thereof. The position sensor can be complemented by a detection of the maintained engagement of the actuating rod 37 by the retaining member. The position of the rod 77 of the cylinder 69 can also be detected and the start-up of the machine can depend on whether the rod 77 is retracted.

The first bearings 25 can be of different types to one another. For example, one of the first bearings 25 is of the general plain bearing type, whereas the other bearing is of the general roller elements type. According to another example, one of the first bearings 25 is of the ball type whereas the other is of the needle type. This also applies to the second bearings 39.

An elastic return member has been described herein in the form of a spring 55 bearing against a large face of the first intermediate crosspiece 21-3 and loaded by compression. To replace or complement this element, the elastic return member can take the form of a helical spring inserted between the shoulder portion 57 and a large face of the second crosspiece 21-4 and loaded by traction. Springs of a different type can also be used, in particular gas springs.

The invention claimed is:

1. Safety device for a bandsaw (1) comprising a frame (17) and a pair of jaws (13) rotatably mounted on the frame (17), said frame (17) configured to be mounted on a framework (3) of the bandsaw (1) with the jaws (13) disposed on either side of a blade (5) of this bandsaw (1), the device further comprising an actuating rod (37) slidably mounted on the frame (17), and at least one elastic return member (55) constraining sliding of the actuating rod (37), wherein a two-way transmission (41) transforms the sliding of the actuating rod (37) into a rotation of the pair of jaws (13), the device further comprises an electromagnetic actuator (65) rigidly connected to the frame (17) and a retaining member rigidly connected to the electromagnetic actuator (65), the actuating rod (37) is arranged with a receiving portion (63) which is capable of engaging with the retaining member when the actuating rod (37) is in a first position relative to the frame (17), the two-way transmission (41) being arranged so that the jaws (13) are distant from one another when the actuating rod (37) is in said first relative position, and the electromagnetic actuator (65) maintains the engagement between the retaining member and the receiving portion (63) as long as the electromagnetic actuator (65) is supplied with current.

2. The device according to claim 1, wherein the electromagnetic actuator (65) releases the engagement between the retaining member and the receiving portion (63) when the electromagnetic actuator (65) is no longer supplied with current.

3. The device according to claim 1, wherein the elastic return member (55) is configured to displace the actuating rod (37) from the first relative position thereof to a second relative position, and the two-way transmission (41) is arranged so that the jaws (13) are proximate one another when the actuating rod (37) is in said second relative position.

4. The device according to claim 3, further comprising an arming mechanism (67) capable of displacing the actuating rod (37) from the second relative position to the first relative position, against the elastic return member (55).

5. The device according to claim 4, wherein the arming mechanism (67) comprises a hinged arm (79) to the frame (17), the hinged arm (79) being capable of being displaced from a position wherein the hinged arm (79) is separate from the actuating rod (37) to a position wherein the hinged arm (79) cooperates with at least a part of this actuating rod (37).

6. The device according to claim 5, wherein the arming mechanism (67) comprises an electric cylinder (69) with a body (71) and a rod (77), the cylinder body (71) is fastened to the frame (17) and wherein the rod (77) is hinged to said arm (79).

7. The device according to claim 3, wherein the jaws (13, 130, 230) comprise an active part (134, 234), at least one part thereof comes into contact with the blade (5) of the saw when the actuating rod (37) is located in the second relative position thereof and the active part (134, 234) of these jaws (13, 130, 230) is devoid of teeth.

8. The device according to claim 7, wherein the jaws (13, 130, 230) have a profile arranged such that said part of the active part (134, 234) of said jaws (13, 130, 230) is located further ahead relative to a virtual line (138) connecting centers of rotation of the jaws (13) to one another.

9. The device according to claim 1, wherein the two-way transmission (41) includes at least one leverage arrangement, and said leverage arrangement is adapted to act on each of the jaws (13).

10. The device according to claim 9, wherein the leverage arrangement includes a pair of connecting rod (43) and crank (51) pairings, each crank (51) being rigidly connected to a respective jaw (13) wherein each connecting rod (43) connects a respective crank (51) to the actuating rod (37).

11. The device according to claim 1, wherein the electromagnetic actuator (65) comprises a lock (65), a magnet thereof forming a retaining member, and the receiving portion (63) of the actuating rod (37) is in the form of a backplate (63), a shape thereof corresponding to the magnet.

12. The device according to claim 1, wherein each of the jaws (13, 130) has a body (131) and a grip jaw (132), the grip jaw being rotatably mounted on the body.

13. The device according to claim 12, wherein each grip jaw (132) carries an active surface that is planar as a whole.

14. Bandsaw (1) comprising a framework (3) and a blade (5), the saw further comprising a safety device comprising a frame (17) and a pair of jaws (13) rotatably mounted on the frame (17), said frame (17) being mounted on the framework (3) with the jaws (13) disposed on either side of the blade (5), the device further comprising an actuating rod (37) slidably mounted on the frame (17), and at least one elastic return member (55) constraining sliding of the actuating rod (37), wherein a two-way transmission (41) transforms the sliding of the actuating rod (37) into a rotation of the pair of jaws (13), the device further comprises an electromagnetic actuator (65) rigidly connected to the frame (17) and a retaining member rigidly connected to the electromagnetic actuator (65), the actuating rod (37) is arranged with a receiving portion (63) which is capable of engaging with the retaining member when the actuating rod (37) is in a first position relative to the frame (17), the two-way transmission (41) being arranged so that the jaws (13) are distant from one another when the actuating rod (37) is in said first relative position, and the electromagnetic actuator (65) maintains engagement between the retaining member and the receiving portion (63) as long as the electromagnetic actuator (65) is supplied with current.

15. The saw according to claim 14, wherein the blade (5) is mounted on the framework (3) via a pair of flywheels (7; 9), the saw further comprising a disengaging system (93) via which at least one of said flywheels (7; 9) is mounted on the framework (3), and the disengaging system (93) is actuated by a second electromagnetic actuator (103) arranged so as to trigger said system in an absence of the feed current.

* * * * *